US008513177B2

(12) United States Patent
Hatzelt et al.

(10) Patent No.: US 8,513,177 B2
(45) Date of Patent: Aug. 20, 2013

(54) DETERGENTS OR CLEANING AGENTS CONTAINING A BLEACH-ENHANCING TRANSITION METAL COMPLEX WHICH IS OPTIONALLY PRODUCED IN SITU

(75) Inventors: Andre Hatzelt, Dusseldorf (DE); Anette Nordskog, Sandefjord (NO); Siglinde Erpenbach, Monheim (DE); Jorg Sundermeyer, Marburg (DE); Felix Gartner, Rostock (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/478,438

(22) Filed: May 23, 2012

(65) Prior Publication Data

US 2012/0264668 A1 Oct. 18, 2012

Related U.S. Application Data

(63) Continuation of application No. PCT/EP2010/067894, filed on Nov. 22, 2010.

(30) Foreign Application Priority Data

Nov. 24, 2009 (DE) ..... 10 2009 047 037

(51) Int. Cl.

| | |
|---|---|
| ***C11D 1/00*** | (2006.01) |
| ***C11D 3/28*** | (2006.01) |
| ***C11D 3/39*** | (2006.01) |
| ***C11D 3/395*** | (2006.01) |

(52) U.S. Cl.

USPC ..... 510/311; 510/376; 510/499; 510/500; 510/505; 252/186.33; 502/200; 502/324; 502/325

(58) Field of Classification Search

USPC ..... 510/311, 376, 99, 500, 505; 252/186.33; 502/200, 324, 325

See application file for complete search history.

(56) References Cited

FOREIGN PATENT DOCUMENTS

| | | | |
|---|---|---|---|
| DE | 2412837 | A | 10/1974 |
| DE | 102007017654 | A1 | 10/2008 |
| WO | 2005/116179 | A1 | 12/2005 |

OTHER PUBLICATIONS

Ujiie et al, "Action Mechanism of 2-(2-Hydroxy-2-n-hexylphenyl)-8-quinolinol-4-carboxylic Acid-with Special Reference to Selective Inhibition of DNA synthesis in Ascites Hepatoma AH 13 Cells in Culture", Chem. Pharm. Bull., 23(1)72-81 (1975).*

PCT International Search Report (PCT/EP2010/067894) dated Mar. 29, 2011.

* cited by examiner

*Primary Examiner* — Gregory Delcotto
(74) *Attorney, Agent, or Firm* — David K. Benson

(57) ABSTRACT

A bleach catalyst includes a complex of Fe—, Mo—, Mn— and/or W with a ligand having a skeleton of formula (I).

(I)

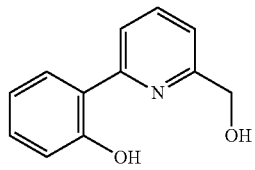

8 Claims, No Drawings

DETERGENTS OR CLEANING AGENTS CONTAINING A BLEACH-ENHANCING TRANSITION METAL COMPLEX WHICH IS OPTIONALLY PRODUCED IN SITU

CROSS-REFERENCES TO RELATED APPLICATIONS

This application is a continuation of PCT/EP2010/067894, filed on Nov. 22, 2010, which claims priority under 35 U.S.C. §119 to DE 10 2009 047 037.9 filed on Nov. 24, 2009, both of which are hereby incorporated by reference.

FIELD OF THE INVENTION

The present invention generally relates to the use of compounds that are able to form complexes with transition metal ions, or to a correspondingly pre-formed transition metal complex, for boosting the cleaning power of washing or cleaning agents against stains, as well as to washing and cleaning agents that comprise complex-forming compounds or the metal complex itself.

BACKGROUND OF THE INVENTION

Inorganic peroxygen compounds, particularly hydrogen peroxide and solid peroxygen compounds that dissolve in water and release hydrogen peroxide, such as sodium perborate and sodium carbonate perhydrate, have long been used as oxidizing agents for disinfection and bleaching purposes. The oxidizing action of these substances in dilute solutions is strongly dependent on the temperature; thus, for example, a sufficiently rapid bleaching of soiled fabrics by $H_2O_2$ or perborate in alkaline bleaching liquor is only achieved at temperatures above about 80° C. The oxidizing action of the inorganic peroxygen compounds at lower temperatures can be improved by the addition of bleach activators that are capable of yielding peroxycarboxylic acids under the given perhydrolysis conditions, and the numerous proposals known from the literature, principally from the classes of materials of the N- or O-acyl compounds, for example reactive esters, polyacylated alkylenediamines, particularly N,N,N',N'-tetraacetylethylenediamine (TAED), acylated glycolurils, particularly tetraacetylglycoluril, N-acylated hydantoins, hydrazides, triazoles, hydrotriazines, urazoles, diketopiperazines, sulfurylamides and cyanurates, also carboxylic acid anhydrides, particularly phthalic anhydride, carboxylic acid esters, particularly sodium nonanoyloxybenzene sulfonate (NOBS), sodium isononanoyloxybenzene sulfonate, O-acylated sugar derivatives, such as pentaacetylglucose, and N-acylated lactams, such as N-benzoyl caprolactam. The bleaching action of aqueous peroxide wash liquors can be increased so much by the addition of these substances that already at temperatures of about 60° C. there is essentially the same activity as for the peroxide wash liquor alone at 95° C.

Using a differentiating approach, it was observed, however, that under fabric washing conditions, such bleach activators that release relatively short chain peroxycarboxylic acids (the most important example of this is TAED) exhibit a particularly pronounced efficiency against hydrophilic colored stains, whereas bleach activators that release relatively longer chain peroxycarboxylic acids (an example of this is NOBS) possess a higher efficiency against hydrophobic colored stains. Largely to achieve on average a high bleaching performance for all possible stains, the addition of mixtures of bleach activators that release percarboxylic acids with different chain lengths has been proposed on various occasions.

In attempts for energy-saving washing and bleaching processes, washing temperatures significantly below 60° C., particularly below 45° C., down to cold water temperature have also grown in importance over the last few years.

In general, the activity of the activator compounds known up to now noticeably decreases at these low temperatures. Therefore, there has been no lack of effort to develop more active activators for this temperature range. However, in specific cases one has to note that a highly active low-temperature bleach activator loses its efficiency at medium or high temperatures, in that higher demands on the cleaning performance of the washing or cleaning agent can similarly require an increased bleaching performance than that of the pure oxidizing agent.

On various occasions, the addition of transition metal compounds, particularly transition metal complexes, has also been proposed to increase the oxidizing strength of peroxygen compounds or also of atmospheric oxygen in washing and cleaning agents. Exemplary transition metal compounds that have been proposed for this purpose include salen complexes of manganese, iron, cobalt, ruthenium or molybdenum, carbonyl complexes of manganese, iron, cobalt, ruthenium or molybdenum, complexes of manganese, iron, cobalt, ruthenium, molybdenum, titanium, vanadium and copper with nitrogen-containing tripod ligands, and manganese complexes with polyazacycloalkane ligands, such as TACN.

BRIEF SUMMARY OF THE INVENTION

It has now been surprisingly found that certain complexes, namely those with a ligand of the imino diol type, as described below, exhibit an excellent bleach-boosting action and boost the cleaning power of washing and cleaning agents, particularly against bleachable, but also against protein-containing stains, without the occurrence of damage to the thus treated fabric from the addition of the agent or from the combined addition of its previously cited components, wherein the bleaching action and cleaning power exceed those obtained by adding customary agents. Protein-containing stains are normally not oxidatively removable from fabrics.

Accordingly, a subject matter of the invention is the use of a bleach catalyst in the form of a complex of Fe, Mo, Mn and/or W, particularly Fe and/or Mn, with a ligand containing a structure of the Formula (I), (I)

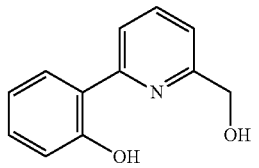

for boosting the cleaning power of washing and cleaning agents, particularly against bleachable and/or protein-containing stains, wherein the structure of the Formula (I) can also be bridged as well as mono or polysubstituted. Generally, the metal-ligand complex can be produced in a facile manner by mixing a metal salt of the corresponding metal with the corresponding ligand in an aqueous medium. The desired oxidation state can be favorably influenced by adjusting the redox potential to a suitable level.

Accordingly, an embodiment of the present invention comprises a washing or cleaning agent comprising a compound containing a structure according to Formula (I) in addition to conventional ingredients that are compatible therewith, wherein the structure of Formula (I) can also be bridged as well as mono or polysubstituted.

Another embodiment of the present invention comprises a washing or cleaning agent comprising a bleach catalyst that is accessible from a compound containing a structure according to Formula (I) by the formation of a complex with Fe, Mo, Mn and/or W, in addition to conventional ingredients that are compatible therewith, wherein the structure of Formula (I) can also be bridged as well as mono or polysubstituted.

Another embodiment of the invention comprises a method of boosting the cleaning power of washing and cleaning agents in an aqueous, especially surfactant-containing liquor that comprises FE, Mo, Mn and/or W ions by combining the washing and cleaning agents with a structure according to Formula (I) or with a bleach catalyst in the form of a complex of Fe, Mo, Mn and/or W containing a ligand with a structure of the Formula (I), wherein the structure of the Formula (I) can also be bridged as well as mono or polysubstituted, and wherein the washing or cleaning agent preferably comprises a peroxygen compound.

An additional embodiment of the present invention comprises a process for washing fabrics or for cleaning hard surfaces, in particular for the automatic cleaning of tableware, involving the addition of a compound containing a structure according to Formula (I), or of a bleach catalyst in the form of a complex of Fe, Mo, Mn, and/or W with a ligand containing a structure of the Formula (I), wherein the structure of the Formula (I) can also be bridged as well as mono or polysubstituted.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The substituents that can be bonded to the basic structure of the Formula (I) can be selected in particular from alkyl, in particular $C_{1-22}$ alkyl, preferably $C_{1-18}$ alkyl, trifluoromethyl, cycloalkyl, in particular $C_{3-8}$ cycloalkyl, cycloalkyl alkyl, in particular $C_{3-8}$ cycloalkyl $C_{1-12}$ alkyl, alkenyl, in particular $C_{2-18}$ alkenyl, alkynyl, in particular $C_{2-18}$ alkynyl, heteroalkyl, heterocycloalkyl, alkoxy, in particular $C_{1-18}$ alkoxy, alkylsulfanyl, in particular $C_{1-18}$ alkylsulfanyl, alkylsulfinyl, in particular $C_{1-18}$ alkylsulfinyl, alkylsulfonyl, in particular $C_{1-18}$ alkylsulfonyl, alkanoyl, in particular $C_{1-18}$ alkanoyl, alkanoyloxy, in particular alkoxycarbonyl, in particular $C_{1-18}$ alkoxycarbonyl, alkylamino carbonyl, in particular $C_{1-18}$ alkylamino carbonyl, alkylsulfanylcarbonyl, in particular $C_{1-18}$ alkylsulfanylcarbonyl, hydroxy, amino, aryl, in particular $C_{6-10}$ aryl, arylalkyl, in particular $C_{6-10}$ aryl $C_{1-12}$ alkyl, aryloxy, in particular $C_{6-10}$ aryloxy, arylsulfanyl, in particular $C_{6-10}$ arylsulfinyl, in particular $C_{6-10}$ arylsulfinyl, arylsulfonyl, in particular $C_{6-10}$ arylsulfonyl, arylcarbonyl, in particular $C_{6-10}$ arylcarbonyl, arylcarbonyloxy, in particular $C_{6-10}$ arylcarbonyloxy, aryloxycarbonyl, in particular $C_{6-10}$ arylsulfanylcarbonyl, heteroaryl, heteroarylalkyl, in particular heteroaryl $C_{1-12}$ alkyl, heteroaryloxy, heteroarylamino, heteroarylsulfanyl, heteroarylsulfonyl, heteroarylsulfoxidyl, heteroarylcarbonyl, heteroarylcarbonyloxy, heteroaryloxycarbonyl, heteroarylamino carbonyl, heteroarylsulfanylcarbonyl, alkoxysulfonyl, in particular $C_{1-18}$ alkoxysulfonyl, alkoxycarbinol, in particular $C_{1-12}$ alkoxycarbinol, ammonium, hydroxycarbonyl, alkoxycarbonyl, in particular C1-18 alkoxycarbonyl, aryloxycarbonyl, in particular $C_{6-10}$ aryloxycarbonyl, amidocarbonyl, halogen, in particular chloride, bromide, iodide or fluoride, nitro, sulfato, sulfo, amidosulfo, phosphato, phosphono, amidophosphono, formyl, thioformyl, $—(CH_2—CH_2—O—)_nH$ and $—(CH_2—CH_2—CH_2—O)_nH$ with n=1 to 20, preferably 3 to 20, wherein all groups of the resulting molecule, in particular the aliphatic and aromatic groups independently of each other can each be also optionally mono or polysubstituted, in particular mono-, di- or tri-substituted, preferably mono-substituted, in particular by substituents selected from the previously cited groups. Bridged structures are obtained by linking two atoms of the basic structure of Formula (I) with a divalent group. Preferred substituted or bridged derivatives of the structure of the general Formula (I) correspond to the Formulas (II) or (III), (II)

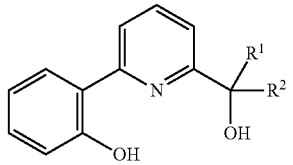

(III)

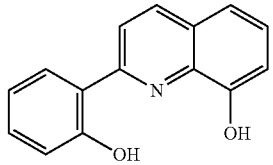

wherein $R^1$ and $R^2$ in Formula (II) independently of one another stand for hydrogen, a phenyl group, a benzyl group or a $C_{1-20}$ alkyl group and preferably $R^1$ and $R^2$ are each a phenyl group.

The inventively aimed success also occurs when the complex in accordance with formula (II) is not added, but rather only the corresponding ligands containing a structure according to Formula (I), and the wash water to be used comprises at least one cited transition metal ion, wherein the oxidation state of the cited metals is not normally important due to the usually rapid adjustment of the redox equilibrium among the various oxidation states present in the wash water. Accordingly, another subject matter of the invention is the use of a compound containing a structure according to Formula (I), (I)

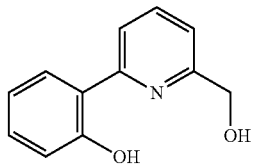

for boosting the cleaning power of washing and cleaning agents, in particular against bleachable and/or protein-containing stains, in aqueous, in particular surfactant-containing liquor that comprises Fe, Mo, and/or W ions, particularly Fe and/or Mn ions.

Further subject matters of the invention are a process for washing fabrics and a process for cleaning hard surfaces, in particular for automatic dishwashing, involving the addition of a compound according to Formula (I) or of a bleach catalyst in the form of an Fe, Mo, Mn and/or W complex, particularly Fe and/or Mn, with a ligand containing a structure of the Formula (I).

In the context of the inventive use and the inventive process, the concentration of the compound containing a structure according to Formula (I) in the aqueous washing or cleaning liquor is preferably 0.5 μmol/l to 1500 μmol/l, in particular 1 μmol/l to 300 μmol/l. The concentration of Fe, Mo, Mn and/or W, in particular Fe and/or Mn, in the aqueous washing or cleaning liquor is preferably in the range of 0.1 μmol/l to 500 μmol/l, in particular 1 μmol/l to 100 μmol/l. Preferred peroxyacid concentrations (calculated as $H_2O_2$) in the washing or cleaning liquor are in the range of 0.001 g/l to 10 g/l, in particular 0.1 g/l to 1 g/l and particularly preferably 0.2 g/l to 0.5 g/l. The inventive use and the inventive process is preferably carried out at temperatures in the range of 10° C. to 95° C., in particular 20° C. to 40° C. The water hardness of the water used for preparing the aqueous washing or cleaning liquor is preferably in the range of 0° dH to 16° dH, in particular 0° dH to 3° dH. The inventive use and the inventive process is preferably carried out at pH values in the range of pH 5 to pH 12, in particular pH 7 to pH 11.

The inventive uses or the inventive processes can be particularly easily realized by adding a washing or cleaning agent that comprises a compound containing a structure according to Formula (I) or a bleach catalyst that is accessible by complex formation from this with a cited transition metal ion. Washing agents for cleaning fabrics and agents for cleaning hard surfaces, in particular dishwasher detergents and among these preferably those for automatic use, which comprise a compound containing a structure according to Formula (I) or a bleach catalyst that is accessible by complex formation from this with a cited transition metal ion in addition to customary ingredients that are compatible therewith, in particular a surfactant, are consequently further subject matters of the invention. Although the inventive success already materializes in the presence of oxygen from the air as the sole oxidizing agent, the inventive use or the inventive process can also be effected in the presence of a peroxygen-containing bleaching agent, or an inventive agent can also additionally comprise a peroxygen-containing bleaching agent.

A bleach-catalyzing complex that possesses a ligand containing a structure according to Formula (I) can possess one or even a plurality of the appropriate ligands, in particular two. It can be mono or optionally di or polynuclear. Moreover it can comprise additional neutral, anionic or cationic ligands, such as for example $H_2O$, $NH_3$, $CH_3OH$, acetylacetone, terpyridine, organic anions, such as citrate, oxalate, tartrate, formate, a $C_{2-18}$ carboxylate, a $C_{1-18}$ alkyl sulfate, in particular methosulfate, or a corresponding alkane sulfonate, inorganic anions, such as for example halides, in particular chloride, perchlorate, tetrafluoroborate, hexafluorophosphate, nitrate, hydrogen sulfate, hydroxide or hydroperoxide. It can also possess bridging ligands, such as for example alkylenediamines.

The inventive agents preferably comprise 0.01 wt % to 2 wt %, particularly 0.1 wt % to 1 wt % of the compound containing a structure according to Formula (I). If a compound containing a structure according to Formula (I) is comprised, then the agent preferably additionally comprises an Fe, Mo, Mn and/or W salt and/or an Fe, Mo, Mn and/or W complex without a ligand that corresponds to the compound containing a structure according to Formula (I). Then the molar ratio of the cited transition metal or the sum of the cited transition metals to the compound according to Formula (I) is preferably in the range of 0.001:1 to 2:1, particularly 0.01:1 to 1:1. In a further preferred development, the inventive agents comprise 0.05 wt % to 1 wt %, particularly 0.1 wt % to 0.5 wt % of a bleach-catalyzing complex that possesses a ligand according to Formula (I). In the context of the inventive use, of the inventive process and of the inventive agent, preferred transition metals are Fe and Mn, particularly Mn.

The peroxygen compounds that are optionally comprised in the agents particularly include organic peracids or peracid salts of organic acids, such as phthalimidopercaproic acid, perbenzoic acid or salts of diperoxydodecanedioic acid, hydrogen peroxide and inorganic salts that liberate hydrogen peroxide under the washing conditions, such as perborate, percarbonate and/or persilicate. Here, hydrogen peroxide can also be produced with the help of an enzymatic system, i.e. an oxidase and its substrates. If it is intended to use solid peroxygen compounds, then they can be used in the form of powders or pellets, which in principle can also be encapsulated by known methods. Alkali percarbonate, alkali perborate monohydrate, alkali perborate tetrahydrate or hydrogen peroxide in the form of aqueous solutions that comprise 3 wt % to 10 wt % hydrogen peroxide are particularly preferably used. Peroxygen compounds are preferably present in inventive washing or cleaning agents in amounts of up to 50 wt %, in particular 5 wt % to 30 wt %.

The inventive agents, which can be present in particular as powdery solids, in the form of post-compacted particles, as homogeneous solutions or suspensions, can comprise in principle all known and customary ingredients for such agents in addition to the inventively used ligands or bleach catalyst. In particular, the inventive agents can comprise builders, surface active surfactants, water-miscible organic solvents, enzymes, sequestrants, electrolytes, pH adjusters, polymers with special effects, such as soil release polymers, color transfer inhibitors, graying inhibitors, crease-reducing polymeric active substances and shape-retaining agents, and further auxiliaries, such as optical brighteners, foam regulators, additional peroxygen activators, colorants and fragrances.

In addition to the previously cited ingredients, an inventive agent can comprise customary antimicrobials for boosting the disinfection action, for example against specific germs. Such antimicrobial additives are preferably comprised in the disinfectants according to the invention in amounts of up to 10 wt %, particularly from 0.1 wt % to 5 wt %.

Customary bleach activators that form peroxycarboxylic acids or peroxyimido acids under perhydrolysis conditions, and/or bleach-activating transition metal complexes can be additionally added to the substance to be used according to the invention. The optional components of the bleach activators, present in particular in amounts of 0.5 wt % to 6 wt %, include the customarily used N- or O-acyl compounds, for example polyacylated alkylenediamines, particularly tetraacetyl ethylenediamine, acylated glycolurils, in particular tetraacetyl glycoluril, N-acylated hydantoins, hydrazides, triazoles, urazoles, diketopiperazines, sulfuryl amides and cyanurates, also carboxylic acid anhydrides, particularly phthalic anhydride, carboxylic acid esters, particularly sodium isononanoylphenol sulfonate, and acylated sugar derivatives, in particular pentaacetylglucose, as well as cationic nitrile derivatives such as trimethylammonium-acetonitrile salts. In order to avoid interaction with the peroxy compounds during storage, the bleach activators can be coated or granulated in a known manner with coating materials, wherein tetraacetylethylenediamine granulated with the help of carboxymethyl cellulose with mean particle sizes of 0.01 mm to 0.8 mm, granulated 1,5-diacetyl-2,4-dioxohexahydro- 1,3,5-triazine, and/or trialkylammonium acetonitrile produced in particle form is particularly preferred. The washing or cleaning agents preferably comprise these types of bleach activators in amounts of up to 8 wt %, particularly 2 wt % to 6 wt %, each based on the total composition.

The inventive agents can comprise one or more surfactants, wherein particularly anionic surfactants, non-ionic surfactants and their mixtures come into consideration, but also cationic, zwitterionic and/or amphoteric surfactants can be comprised. Suitable non-ionic surfactants are particularly alkyl glycosides and ethoxylation and/or propoxylation products of alkyl glycosides or of linear or of branched alcohols, each with 12 to 18 carbon atoms in the alkyl moiety and 3 to 20, preferably 4 to 10 alkyl ether groups. Moreover, corresponding ethoxylation and/or propoxylation products of N-alkylamines, vicinal diols, fatty acid esters and fatty acid amides, which in regard to the alkyl moiety correspond to the cited long chain alcohol derivatives, as well as of alkyl phenols with 5 to 12 carbon atoms in the alkyl group, can be used.

Suitable anionic surfactants are particularly soaps and such that comprise sulfate or sulfonate groups, preferably with alkali metal ions as the cations. Useable soaps are preferably the alkali metal salts of the saturated or unsaturated fatty acids containing 12 to 18 carbon atoms. These types of fatty acids can also be used in a not completely neutralized form. The useable surfactants of the sulfate type include the salts of sulfuric acid half esters of fatty alcohols with 12 to 18 carbon atoms and the sulfation products of the mentioned non-ionic surfactants with a low degree of ethoxylation. The useable surfactants of the sulfonate type include linear alkylbenzene sulfonates with 9 to 14 carbon atoms in the alkyl moiety, alkyl sulfonates with 12 to 18 carbon atoms, as well as olefin sulfonates with 12 to 18 carbon atoms, which result from the reaction of corresponding monoolefins with sulfur trioxide, as well as alpha-sulfofatty acid esters that result from the sulfonation of fatty acid methyl or ethyl esters.

These types of surfactants are preferably comprised in the inventive cleaning or washing agents in amounts of 5 wt % to 50 wt %, particularly 8 wt % to 30 wt %, whereas the inventive disinfectants also like the inventive cleaning agents, comprise preferably 0.1 wt % to 20 wt %, particularly 0.2 to 5 wt % surfactants.

The inventive agents, in particular when they concern those intended for the treatment of fabrics, can comprise in particular one or more of the cationic fabric softeners of the general Formulas X, XI or XII as the cationic active substances with fabric softening action:

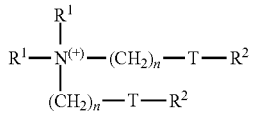

(X)

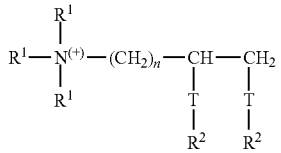

(XI)

-continued

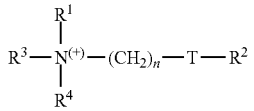

(XII)

in which each group $R^1$, independently of one another, is selected from $C_{1-6}$ alkyl, $C_{1-6}$ alkenyl or $C_{1-6}$ hydroxyalkyl groups; each group $R^2$, independently of one another, is selected from $C_{8-28}$ alkyl or $C_{8-28}$ alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO— or —CO—O— and n is an integer from 0 to 5. The cationic surfactants possess the usual number and type of anions required to compensate the charge, wherein these can be selected, besides for example halides, also from the anionic surfactants. In preferred embodiments of the present invention, hydroxyalkyltrialkylammonium compounds, particularly $C_{12-18}$ alkyl(hydroxyethyl)dimethylammonium compounds, and preferably their halides, in particular chlorides, are used as the cationic surfactants. An inventive agent preferably comprises 0.5 wt % to 25 wt %, particularly 1 wt % to 15 wt % of cationic surfactant.

An inventive agent preferably comprises at least one water-soluble and/or water-insoluble organic and/or inorganic builder. Suitable dispersion agents include polycarboxylic acids, particularly citric acid and sugar acids, monomeric and polymeric amino polycarboxylic acids, particularly methylglycine diacetic acid, nitrilotriacetic acid and ethylenediamine tetraacetic acid as well as polyaspartic acid, polyphosphonic acids, particularly amino tris(methylenephosphonic acid), ethylenediaminetetrakis(methylene-phosphonic acid) and 1-hydroxyethane-1,1-diphosphonic acid, polymeric hydroxyl compounds such as dextrin as well as polymeric (poly)carboxylic acids, particularly those polycarboxylates obtained from the oxidation of polysaccharides or dextrins, and/or polymeric acrylic acids, methacrylic acids, maleic acids and mixed polymers thereof, which can also comprise small amounts of copolymerized polymerizable substances exempt from carboxylic acid functionality. The relative molecular weight of the homopolymers of unsaturated carboxylic acids lies generally between 5000 and 200,000, that of the copolymers between 2000 and 200,000, preferably 50,000 to 120,000, each based on free acid. A particularly preferred acrylic acid-maleic acid copolymer has a relative molecular weight of 50,000 to 100,000. Suitable, yet less preferred compounds of this class, are copolymers of acrylic acid or methacrylic acid with vinyl ethers, such as vinyl methyl ether, vinyl esters, ethylene, propylene and styrene, in which the content of the acid is at least 50 wt %. Terpolymers, which comprise two unsaturated acids and/or their salts as monomers as well as vinyl alcohol and/or an esterified vinyl alcohol or a carbohydrate as the third monomer, can also be used as the water-soluble organic builders. The first acidic monomer or its salt is derived from a monoethylenically unsaturated $C_3$-$C_8$ carboxylic acid and preferably from a $C_3$-$C_4$ monocarboxylic acid, particularly from (meth)acrylic acid. The second acidic monomer or its salt can be a derivative of a $C_4$-$C_8$ dicarboxylic acid, maleic acid being particularly preferred, and/or a derivative of an allyl sulfonic acid, which is substituted in the 2-position with an alkyl or aryl group. These types of polymer generally have a relative molecular weight between 1000 and 200,000. Other preferred copolymers are those, which preferably contain acrolein and acrylic acid/acrylic acid salts or vinyl acetate as monomers. The organic builders, especially for the manufacture of liquid agents, can be added in the form of aqueous solutions, preferably in the form of 30 to 40 weight percent aqueous solutions. In general, all the cited acids are added in the form of their water-soluble salts, particularly their alkali metal salts.

These types of organic builders can be comprised as desired in amounts of up to 40 wt %, particularly up to 25 wt % and preferably from 1 wt % to 8 wt %. Amounts close to the cited upper limit are preferably added in pasty or liquid, particularly aqueous, inventive agents.

The water-soluble inorganic builders particularly concern polymeric alkali metal phosphates that can be present in the form of their alkaline, neutral or acidic sodium or potassium salts. Examples are tetrasodium diphosphate, disodium dihydrogen diphosphate, pentasodium triphosphate, so-called sodium hexametaphosphate as well as the corresponding potassium salts or mixtures of sodium and potassium salts. In particular, crystalline or amorphous alkali metal aluminosilicates in amounts of up to 50 wt %, preferably not more than 40 wt % and in liquid agents not more than 1 wt % to 5 wt % are added as the water-insoluble, water-dispersible inorganic builders. Among these, the detergent-quality crystalline sodium aluminosilicates, particularly zeolites A, P and optionally X, are preferred. Amounts close to the cited upper limit are preferably incorporated in solid, particulate agents. Suitable aluminosilicates particularly exhibit no particles with a particle size above 30 μm and preferably consist to at least 80 wt % of particles smaller than 10 μm. Their calcium binding capacity, which can be determined according to the indications of German patent DE 24 12 837, generally lies in the range of 100 to 200 mg CaO per gram.

Suitable substitutes or partial substitutes for the cited aluminosilicate are crystalline alkali metal silicates that can be present alone or in a mixture with amorphous silicates. The alkali metal silicates that can be used as builders in the inventive agents preferably have a molar ratio of alkali metal oxide to $SiO_2$ below 0.95, particularly 1:1.1 to 1:12 and can be amorphous or crystalline. Preferred alkali metal silicates are the sodium silicates, particularly the amorphous sodium silicates, with a molar ratio $Na_2O:SiO_2$ of 1:2 to 1:2.8. Crystalline silicates that can be present alone or in a mixture with amorphous silicates are preferably crystalline, layered silicates corresponding to the general formula $Na_2Si_xO_{2x+1}yH_2O$, in which x, the so-called module, is a number from 1.9 to 4 and y is a number from 0 to 20, preferred values for x being 2, 3 or 4. Preferred crystalline layered silicates are those in which x assumes the values 2 or 3 in the cited general formula. Both β- and δ-sodium disilicates $Na_2Si_2O_5\ yH_2O$ are preferred. Practically anhydrous crystalline alkali metal silicates of the abovementioned general formula, in which x is a number from 1.9 to 2.1 can also be manufactured from amorphous alkali metal silicates, and can be used in inventive agents. In a further preferred embodiment of the composition according to the invention, a crystalline sodium layered silicate with a module of 2 to 3 is added, as can be manufactured from sand and soda. In a further preferred embodiment of the inventive agent, crystalline sodium silicates with a module in the range 1.9 to 3.5 can be added. In a preferred development of the inventive agent, a granular compound of alkali metal silicate and alkali metal carbonate is added, as is commercially available, for example under the name Nabion® 15. In the case that alkali metal aluminosilicate, in particular zeolite, is also present as the additional builder, then the weight ratio aluminosilicate to silicate, each based on the anhydrous active substances, is preferably 1:10 to 10:1. In agents that comprise both amorphous and crystalline alkali metal silicates, the weight ratio of amorphous alkali metal silicate to crystalline alkali metal silicate is preferably 1:2 to 2:1 and particularly 1:1 to 2:1.

Builders are preferably comprised in the inventive washing or cleaning agents in amounts of up to 60 wt %, particularly from 5 wt % to 40 wt %.

In a preferred development of the invention, an inventive agent includes a water-soluble builder block. The use of the term "builder block" is intended to emphasize that the agents do not comprise other builders than water-soluble builders, i.e. all of the builders comprised in the agent are summarized in the stated "block", wherein at the most, allowance is made for the amounts of materials that can be comprised in the customary ingredients of commercial agents as impurities or minor amounts of added stabilizers. The term "water-soluble" is intended to mean that the builder block, in the amount comprised in the agent, in normal conditions, dissolves without residue. The inventive agents preferably comprise at least 15 wt % and up to 55 wt %, particularly 25 wt % to 50 wt %, of water-soluble builder block. They are preferably composed of the components a) 5 wt % to 35 wt % of citric acid, alkali metal citrate and/or alkali metal carbonate that can also be replaced at least in part by alkali metal hydrogen carbonate.
b) up to 10 wt % alkali metal silicate with a module in the range of 1.8 to 2.5,
c) up to 2 wt % phosphonic acid and/or alkali metal phosphonate,
d) up to 50 wt % alkali metal phosphate, and
e) up to 10 wt % polymeric polycarboxylate, wherein the quantities are based on the total washing or cleaning agent. This is also true for all of the following quantities, when not otherwise stated.

In a preferred embodiment of the inventive agent, the water-soluble builder block comprises at least 2 of the components b), c), d) and e) in amounts of greater than 0 wt %.

With regard to component a), in a preferred embodiment of the inventive agent, are comprised 15 wt % to 25 wt % alkali metal carbonate that can be replaced at least in part by alkali metal hydrogen carbonate, and up to 5 wt %, particularly 0.5 wt % to 2.5 wt % citric acid and/or alkali metal citrate. In an alternative embodiment of the inventive agent, the component a) comprises 5 wt % to 25 wt %, particularly 5 wt % to 15 wt % citric acid and/or alkali metal citrate and up to 5 wt %, particularly 1 wt % to 5 wt %, alkali metal carbonate that can be replaced at least in part by alkali metal hydrogen carbonate. If both alkali metal carbonate and also alkali metal hydrogen carbonate are present, then the component a) preferably includes alkali metal carbonate and alkali metal hydrogen carbonate in the weight ratio of 10:1 to 1:1.

With regard to component b), in a preferred embodiment of the inventive agent, there are comprised 1 wt % to 5 wt % alkali metal silicate with a modulus in the range 1.8 to 2.5.

With regard to component c), in a preferred embodiment of the inventive agent, there are comprised 0.05 wt % to 1 wt % phosphonic acid and/or alkali metal phosphonate. Phosphonic acids are also understood to include optionally substituted alkyl phosphonic acids that may also possess a plurality of phosphonic acid groups (so-called polyphosphonic acids). They are preferably selected from the hydroxy and/or aminoalkyl phosphonic acids and/or their alkali metal salts, such as, for example, dimethylaminomethane diphosphonic acid, 3-aminopropane-1-hydroxy-1,1-diphosphonic acid, 1-amino-1-phenyl-methane diphosphonic acid, 1-hydroxyethane-1,1-diphosphonic acid, amino-tris(methylene phosphonic acid), N,N,N',N'-ethylenediamine-tetrakis(methylene phosphonic acid) and acetylated derivatives of the phosphorous acids, which can also be employed in any mixtures.

With regard to component d), in a preferred embodiment of the inventive agent, there are comprised 15 wt % to 35 wt % alkali metal phosphate, in particular trisodium polyphosphate. "Alkali metal phosphate" is the collective term for the alkali metal (more particularly sodium and potassium) salts of the various phosphoric acids, in which metaphosphoric acids $(HPO_3)_n$ and orthophosphoric acid ($H_3PO_4$) can be differentiated among representatives of higher molecular weight. The phosphates combine several inherent advantages: They act as alkalinity sources, prevent lime deposits on machine parts and lime incrustations in fabrics and, in addition, contribute towards the cleaning power. Sodium dihydrogen phosphate $NaH_2PO_4$ exists as the dihydrate (density 1.91 $g \cdot cm^{-3}$, melting point 60° C.) and as the monohydrate (density 2.04 $gcm^{-3}$). Both salts are white, readily water-soluble powders that on heating, lose the water of crystallization and at 200° C. are converted into the weakly acidic diphosphate (disodium hydrogen diphosphate, $Na_2H_2P_2O_7$) and, at higher temperatures into sodium trimetaphosphate ($Na_3P_3O_9$) and Maddrell's salt. $NaH_2PO_4$ shows an acidic reaction. It is formed by adjusting phosphoric acid with sodium hydroxide to a pH value of 4.5 and spraying the resulting "mash". Potassium dihydrogen phosphate (primary or monobasic potassium phosphate, potassium biphosphate, KDP), $KH_2PO_4$, is a white salt with a density of 2.33 $gcm^{-3}$, has a melting point of 253° C. [decomposition with formation of potassium polyphosphate $(KPO_3)_x$] and is readily soluble in water. Disodium hydrogen phosphate (secondary sodium phosphate), $Na_2HPO_4$, is a colorless, very readily water-soluble crystalline salt. It exists in anhydrous form and with 2 mol (density 2.066 $gcm^3$, water loss at 95° C.), 7 mol (density 1.68 $gcm^3$, melting point 48° C. with loss of $5H_2O$) and 12 mol of water (density 1.52 $gcm^{-3}$, melting point 35° C. with loss of $5H_2O$), becomes anhydrous at 100° C. and, on fairly intensive heating, is converted into the diphosphate $Na_4P_2O_7$. Disodium hydrogen phosphate is prepared by neutralization of phosphoric acid with soda solution using phenolphthalein as the indicator. Dipotassium hydrogen phosphate (secondary or dibasic potassium phosphate), $K_2HPO_4$, is an amorphous white salt, which is readily soluble in water. Trisodium phosphate, tertiary sodium phosphate, $Na_3PO_4$, are colorless crystals with a density of 1.62 $gcm^{-3}$ and a melting point of 73-76° C. (decomposition) as the dodecahydrate, as the decahydrate (corresponding to 19-20% $P_2O_5$) a melting point of 100° C., and in anhydrous form (corresponding to 39-40% $P_2O_5$) a density of 2.536 $gcm^{-3}$. Trisodium phosphate is readily soluble in water with an alkaline reaction and is manufactured by evaporating a solution of exactly 1 mole disodium phosphate and 1 mole NaOH. Tripotassium phosphate (tertiary or tribasic potassium phosphate), $K_3PO_4$, is a white deliquescent granular powder with a density of 2.56 $gcm^{-3}$, has a melting point of 1340° C. and is readily soluble in water through an alkaline reaction.

It is produced by e.g. heating Thomas slag with carbon and potassium sulfate. Despite their higher price, the more readily soluble and therefore highly effective potassium phosphates are often preferred to the corresponding sodium compounds in the detergent industry. Tetrasodium diphosphate (sodium pyrophosphate), $Na_4P_2O_7$, exists in anhydrous form (density 2.534 $gcm^{-3}$, melting point 988° C., a figure of 880° C. has also been mentioned) and as the decahydrate (density 1.815-1.836 $gcm^{-3}$, melting point 94° C. with loss of water). Both substances are colorless crystals that dissolve in water with an alkaline reaction. $Na_4P_2O_7$ is formed when disodium phosphate is heated to more than 200° C. or by reacting phosphoric acid with soda in a stoichiometric ratio and spray drying the solution. The decahydrate complexes heavy metal salts and hardness salts and, hence, reduces the hardness of water. Potassium diphosphate (potassium pyrophosphate), $K_4P_2O_7$, exists in the form of the trihydrate and is a colorless hygroscopic powder with a density of 2.33 $gcm^{-3}$, which is soluble in water, the pH of a 1% solution at 25° C. being 10.4. Relatively high molecular weight sodium and potassium phosphates are formed by condensation of $NaH_2PO_4$ or $KH_2PO_4$. They may be divided into cyclic types, namely the sodium and potassium metaphosphates, and chain types, the sodium and potassium polyphosphates. In particular, the latter are known by various different names: fused or calcined phosphates, Graham's salt, Kurrol's salt and Maddrell's salt. All higher sodium and potassium phosphates are known collectively as condensed phosphates. The industrially important pentasodium triphosphate, $Na_5P_3O_{10}$ (sodium tripolyphosphate), is anhydrous or crystallizes with $6H_2O$ to a non-hygroscopic white water-soluble salt which and which has the general formula NaO—[P(O)(ONa)—O]$_n$—Na where n=3. Around 17 g of the salt free from water of crystallization dissolve in 100 g of water at room temperature, around 20 g at 60° C. and around 32 g at 100° C. After heating the solution for 2 hours to 100° C., around 8% orthophosphate and 15% diphosphate are formed by hydrolysis. In the preparation of pentasodium triphosphate, phosphoric acid is reacted with soda solution or sodium hydroxide in a stoichiometric ratio and the solution is spray-dried. Similarly to Graham's salt and sodium diphosphate, pentasodium triphosphate solubilizes many insoluble metal compounds (including lime soaps, etc.). $K_5P_3O_{10}$ (potassium tripolyphosphate), is marketed for example in the form of a 50% by weight solution (>23% $P_2O_5$, 25% $K_2O$). The potassium polyphosphates are widely used in the washing and cleaning industry. Sodium potassium tripolyphosphates also exist and are also usable in the scope of the present invention. They are formed for example when sodium trimetaphosphate is hydrolyzed with KOH:

$$(NaPO_3)_3+2KOH \rightarrow Na_3K_2P_3O_{10}+H_2O$$

According to the invention, they may be used in exactly the same way as sodium tripolyphosphate, potassium tripolyphosphate or mixtures thereof. Mixtures of sodium tripolyphosphate and sodium potassium tripolyphosphate or mixtures of potassium tripolyphosphate and sodium potassium tripolyphosphate or mixtures of sodium tripolyphosphate and potassium tripolyphosphate and sodium potassium tripolyphosphate may also be used in accordance with the invention.

With regard to component e), in a preferred embodiment of the inventive agent, there are comprised 1.5 wt % to 5 wt % of polymeric polycarboxylate, particularly selected from the polymerization or copolymerization products of acrylic acid, methacrylic acid and/or maleic acid. Among these are the homopolymers of acrylic acid and more specifically those with an average molecular weight in the range of 5000 D to 15 000 D (PA standard) are particularly preferred.

Apart from the abovementioned oxidases, enzymes that can be used in the agents are those from the class of proteases, lipases, cutinases, amylases, pullulanases, mannanases, cellulases, hemicellulases, xylanases and peroxidases as well as their mixtures, for example proteases like BLAP®, Optimase®, Opticlean®, Maxacal®, Maxapem®, Alcalase®, Esperase®, Savinase®, Durazym® and/or Purafect® OxP, amylases like Termamyl®, Amylase-LT®, Maxamyl®, Duramyl® and/or Purafect® OxAm, lipases like Lipolase®, Lipomax®, Lumafast® and/or Lipozym®, cellulases like Celluzyme® and/or Carezyme®. Enzymatic active materials obtained from bacterial sources or fungi such as *Bacillus*

*subtilis, Bacillus licheniformis, Streptomyceus griseus, Humicola lanuginosa, Humicola insolens, Pseudomonas Pseudoalcaligenes* or *Pseudomonas cepacia* are particularly suitable. The enzymes can be adsorbed on carriers and/or embedded in encapsulants in order to protect them against premature inactivation. They are comprised in the inventive washing, cleaning agents or disinfectants preferably in amounts of up to 10 wt %, particularly 0.2 wt % to 2 wt %, wherein enzymes that are stabilized against oxidative decomposition are particularly preferably employed.

In a preferred embodiment of the invention, the agent comprises 5 wt % to 50 wt %, particularly 8 to 30 wt % anionic and/or non-ionic surfactant, up to 60 wt %, particularly 5-40 wt % builder and 0.2 wt % to 2 wt % enzyme, selected from the proteases, lipases, cutinases, amylases, pullulanases, mannanases, cellulases, oxidases and peroxidases as well as their mixtures.

Organic solvents that can be employed in the inventive agents, particularly when the agents are in liquid or paste form, include alcohols with 1 to 4 carbon atoms, particularly methanol, ethanol, isopropanol and tert-butanol, diols with 2 to 4 carbon atoms, particularly ethylene glycol and propylene glycol, their mixtures and the ethers derived from the cited classes of compounds. These types of water-miscible solvent are preferably present in the inventive washing agents in amounts of not more than 30 wt %, particularly 6 wt % to 20 wt %.

To adjust a pH resulting from mixing the usual components to a desired level, the inventive agents can comprise acids that are compatible with the system and the environment, particularly citric acid, acetic acid, tartaric acid, malic acid, glycolic acid, succinic acid, glutaric acid and/or adipic acid, and also mineral acids, particularly sulfuric acid or bases, particularly ammonium hydroxide or alkali metal hydroxides. These types of pH adjustors are preferably comprised in the inventive agents in amounts of not more than 20 wt %, particularly 1.2 wt % to 17 wt %.

"Soil release" polymers or soil release substances that provide the treated surface of fibers, for example, with soil repellency are known as "soil repellents" and are non-ionic or cationic cellulose derivatives, for example. In particular, the active polyester soil release polymers include copolyesters of dicarboxylic acids, for example adipic acid, phthalic acid or terephthalic acid, diols, for example ethylene glycol or propylene glycol, and polydiols, for example polyethylene glycol or polypropylene glycol. The preferred soil release polyesters employed include such compounds that are formally obtained by the esterification of two monomeric moieties, wherein the first monomer is a dicarboxylic acid HOOC-Ph-COOH and the second monomer is a diol $HO—(CHR^{11}—)_a OH$ that can also be present as the polymeric diol $H—(O—(CHR^{11}—)_a)_b OH$. Here, Ph means an o-, m- or p-phenylene group that can carry 1 to 4 substituents selected from alkyl groups with 1 to 22 carbon atoms, sulfonic acid groups, carboxyl groups and their mixtures, $R^{11}$ is hydrogen, an alkyl group with 1 to 22 carbon atoms and their mixtures, a is a number from 2 to 6 and b is a number from 1 to 300. Monomeric diol units $—O—(CHR—)_a O—$ as well as polymeric diol units $—(O—(CHR—)_a)_b O—$ are preferably present in the polyesters resulting from these. The molar ratio of monomeric diol units to polymeric diol units is preferably in the range 100:1 to 1:100, particularly 10:1 to 1:10. The degree of polymerization b of the polymeric diol units is preferably in the range 4 to 200, particularly 12 to 140. The molecular weight or the average molecular weight or the maximum of the molecular weight distribution of preferred soil-releasing polyesters is in the range 250 to 100 000, particularly 500 to 50 000. The acid based on the Ph group is preferably selected from terephthalic acid, isophthalic acid, phthalic acid, trimellitic acid, mellitic acid, the isomers of sulfo phthalic acid, sulfo isophthalic acid and sulfo terephthalic acid and their mixtures. As long as their acid groups are not part of the ester linkages in the polymer, then they are preferably present in salt form, particularly as the alkali metal or ammonium salt. Among these, sodium and potassium salts are particularly preferred. If desired, instead of the monomer HOOC-Ph-COOH, small amounts, particularly not more than 10 mol % of other acids that possess at least two carboxyl groups, based on the fraction of Ph with the abovementioned meaning, can be comprised in the soil release polyester. Exemplary alkylene and alkenylene dicarboxylic acids include malonic acid, succinic acid, fumaric acid, maleic acid, glutaric acid, adipic acid, pimelic acid, suberic acid, azelaic acid and sebacic acid. The preferred diols $HO—(CHR^{11}—)_a OH$ include those in which $R^{11}$ is hydrogen and a is a number from 2 to 6, and those, in which a has the value 2 and $R^{11}$ is selected from hydrogen and alkyl groups with 1 to 10, particularly 1 to 3 carbon atoms. The last named diols are particularly preferably those of the formula $HO—CH_2—CHR^{11}OH$, in which $R^{11}$ has the abovementioned meaning. Exemplary diol components are ethylene glycol, 1,2-propylene glycol, 1,3-propylene glycol, 1,4-butane diol, 1,5-pentane diol, 1,6-hexane diol, 1,8-octane diol, 1,2-decane diol, 1,2-dodecane diol and neopentyl glycol. Polyethylene glycol with an average molecular weight of 1000 to 6000 is particularly preferred among the polymeric diols. If desired, these polyesters can be end blocked, wherein the blocking groups can be alkyl groups with 1 to 22 carbon atoms and esters of monocarboxylic acids. The end groups bonded through ester linkages can be based on alkyl, alkenyl and aryl monocarboxylic acids containing 5 to 32 carbon atoms, particularly 5 to 18 carbon atoms. They include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselic acid, petroselaidic acid, oleic acid, linoleic acid, linolaidic acid, linolenic acid, elaiostearic acid, arachic acid, gadoleic acid, arachidonic acid, behenic acid, erucic acid, brassidic acid, clupanodonic acid, lignoceric acid, cerotic acid, melissic acid, benzoic acid that can carry 1 to 5 substituents with a total of up to 25 carbon atoms, particularly 1 to 12 carbon atoms, for example tert.-butylbenzoic acid. The end groups can also be based on hydroxymonocarboxylic acids containing 5 to 22 carbon atoms, examples of which include hydroxyvaleric acid, hydroxycaproic acid, ricinoleic acid, its hydrogenation product hydroxystearic acid, and o-, m- and p-hydroxybenzoic acid. The hydroxymonocarboxylic acids can themselves be linked with one another through their hydroxyl group and their carboxyl group and thus be present several fold in an end group. Preferably, the number of hydroxymonocarboxylic acid units per end group, i.e. their degree of oligomerization, is in the range 1 to 50, particularly 1 to 10. In a preferred development of the invention, polymers of ethylene terephthalate and polyethylene oxide terephthalate are used, in which the polyethylene glycol units have a molecular weight 750 to 5000 and the molar ratio of ethylene terephthalate to polyethylene oxide terephthalate is 50:50 to 90:10, alone or in combination with cellulose derivatives.

Color transfer inhibitors that can be used in inventive agents for washing textiles particularly include polyvinyl pyrrolidones, polyvinyl imidazoles, polymeric N-oxides such as polyvinyl pyridine-N-oxide and copolymers of vinyl pyrrolidone with vinyl imidazole and optionally further monomers.

As fabric surfaces, particularly of rayon, spun rayon, cotton and their mixtures, can crease of their own accord because the individual fibers are sensitive to flection, bending, pressing and squeezing at right angles to the fiber direction, the inventive agents can comprise anti-crease agents. They include for example synthetic products based on fatty acids, fatty acid esters, fatty acid amides, fatty acid alkylol esters, fatty acid alkylol amides or fatty alcohols that have mainly been treated with ethylene oxide, or products based on lecithin or modified phosphoric acid esters.

Graying inhibitors have the task of ensuring that the dirt removed from the hard surface and particularly from the textile fibers is held suspended in the wash liquid. Water-soluble colloids of mostly organic nature are suitable for this, for example glue, gelatins, salts of ether carboxylic acids or ether sulfonic acids of starches or celluloses, or salts of acidic sulfuric acid esters of celluloses or starches. Water-soluble, acid group-containing polyamides are also suitable for this purpose. Moreover, aldehyde starches, for example, can be used instead of the abovementioned starch derivatives. Preference, however, is given to the use of cellulose ethers such as carboxymethyl cellulose (Na salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, which can be added, for example in amounts of 0.1 to 5 wt %, based on the agent.

The agents may comprise optical brighteners, in particular derivatives of diaminostilbene disulfonic acid or alkali metal salts thereof. Suitable optical brighteners are, for example, salts of 4,4'-bis-(2-anilino-4-morpholino-1,3,5-triazinyl-6-)stilbene-2,2'-disulfonic acid or compounds of similar structure which contain a diethanolamino group, a methylamino group, an anilino group or a 2-methoxyethylamino group instead of the morpholino group. Optical brighteners of the substituted diphenylstyryl type may also be present, for example the alkali metal salts of 4,4'-bis(2-sulfostyryl)diphenyl, 4,4'-bis(4-chloro-3-sulfostyryl)diphenyl or 4-(4-chlorostyryl)-4'-(2-sulfostyryl)diphenyl. Mixtures of the abovementioned optical brighteners may also be used.

Particularly when used in automatic washing or cleaning processes, it can be advantageous to add conventional foam inhibitors to the compositions. Suitable foam inhibitors include for example, soaps of natural or synthetic origin, which have a high content of $C_{18}$-$C_{24}$ fatty acids. Suitable non-surface-active types of foam inhibitors are, for example, organopolysiloxanes and mixtures thereof with microfine, optionally silanized silica and also paraffins, waxes, microcrystalline waxes and mixtures thereof with silanized silica or bis-fatty acid alkylenediamide. Mixtures of various foam inhibitors, for example mixtures of silicones, paraffins or waxes, are also used with advantage. Preferably, the foam inhibitors, especially silicone-containing and/or paraffin-containing foam inhibitors, are loaded onto a granular, water-soluble or dispersible carrier material. Especially in this case, mixtures of paraffins and bis stearylethylene diamide are preferred.

Furthermore, active substances to prevent tarnishing of silver objects, so-called silver corrosion inhibitors, can be added to the inventive agents. Preferred silver corrosion inhibitors are organic disulfides, dihydric phenols, trihydric phenols, optionally alkyl or aminoalkyl substituted triazoles such as benzotriazole and salts and/or complexes of cobalt, manganese, titanium, zirconium, hafnium, vanadium, or cerium, in which the cited metals are present in the valence states II, III, IV, V or VI.

The compound containing a structure according to Formula (I) or the corresponding pre-prepared complex can be present in the form of powders or as granulates that can also be optionally coated and/or colored and can comprise conventional carrier materials and/or granulation auxiliaries. In the case that they are used in granular form, they can also comprise, if desired, additional active substances, particularly bleach activators.

The manufacture of inventive solid agents is not difficult and in principle can be made by known methods, for example by spray drying or granulation, wherein the peroxygen compounds and bleach activator combinations are optionally added later. For manufacturing the inventive agent with an increased bulk density, particularly in the range of 650 g/l to 950 g/l, a preferred process is one with an extrusion step. Inventive detergents, cleansing agents or disinfectants in the form of aqueous solutions or other solutions comprising standard solvents are particularly advantageously manufactured by a simple mixing of the ingredients, which can be added into an automatic mixer as such or as a solution. In a preferred embodiment of agents for the in particular automatic washing of tableware, they are in the form of tablets.

EXAMPLES

Example 1

Preparation of 2-(2-hydroxyphenyl)quinolin-8-ol (hpc)

1.1. Preparation of 2-lithioanisole

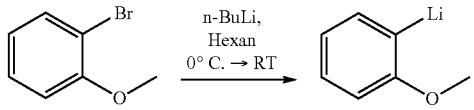

2-Bromoanisole (97.0 g, 0.52 mol, 1.0 eq) was dissolved in 150 ml pentane. A 1.6M solution of n-butyllithium (0.52 mol, 1.0 eq) in 325 ml hexane was slowly added drop wise with vigorous stirring and cooling with an ice bath. A white suspension formed which was stirred for a further 3 hours at 0° C., then for 9 hours at room temperature. The white solid was filtered off and washed with pentane (4×30 ml). After drying under vacuum, 2-lithioanisole was isolated as a fine white powder.

Yield: white powder, 48.7 g (82%), stored in the glove box.

$^1$H-NMR (300.1 MHz, $C_6D_6$), δ/ppm=7.99 (dd, 1H, $^3J_{HH}$=6.3 Hz, $^4J_{HH}$=1-4 Hz, H5), 7.32 (ddd, 1H, $^3J_{HH}$=7.6 HZ, $^3J_{HH}$=7.6 HZ, $^4J_{HH}$=1.6 HZ, H4), 7.18 (d, 1H, $^3J_{HH}$=6.6 Hz, H7), 6.58 (dd, 1H, $^3J_{HH}$=8.12 Hz, H6), 3.08 (s, 3H, O—$CH_3$).

$^{13}$C-NMR (100 MHz, $C_6D_6$), δ/ppm=170.4, 156.9 (C1), 141.8, 129.3, 123.6, 107.9, 54.9 (O—$CH_3$).

1.2. Preparation of 8-methoxy-2-(2-methoxyphenyl)quinoline

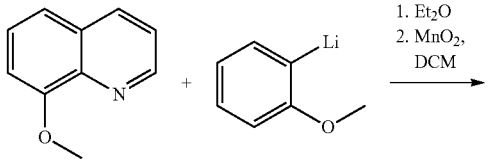

-continued

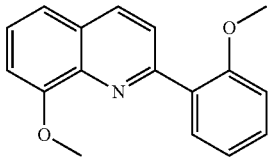

A solution of 8-methoxyquinoline (5.54 g, 34.8 mmol, 1.0 eq) in 55 ml diethyl ether was slowly dropped (within about 30 min) into a solution of o-lithioanisole (4.37 g, 38.4 mmol, 1.1 eq) in 55 ml diethyl ether (each 55 mL). A yellow green fluorescing solution was formed. At the conclusion of the addition, stirring was continued at room temperature for a further 2 hours, after which no more educt could be detected by thin layer chromatography. During the reaction, the color of the reaction mixture changed from fluorescent yellow to green to green-brown. The reaction mixture was worked up by adding it to ice and subsequent extraction with diethyl ether (3×40 ml). The combined organic phases (yellow) were dried over $MgSO_4$ and the solvent was removed in a rotary evaporator. The residue was dissolved in 200 ml dichloromethane and stirred with ca. 40 equivalents of activated manganese dioxide (Merck) until the thin layer chromatographic control (ethyl acetate/hexane=4/6) showed that all of the crude product had reacted. The manganese dioxide was filtered off and the solvent removed in the rotary evaporator. The product was dried under vacuum.

Yield: beige solid, 9.0 g (97%).

$^1$H-NMR (300.1 MHz, $CDCl_3$), δ/ppm=8.07 (d, 1H, $^3J_{HH}$=8.7 Hz, H4) 7.95 (dd, 1H, $^3J_{HH}$=7.5 Hz, $^4J_{HH}$=1.8 Hz, H3'), 7.93 (d, 1H, $^3J_{HH}$=8.7 Hz, H3), 7.44-7.35 (m, 3H, H5', H6, H5), 7.12 (ddd, 1H, $^3J_{HH}$=7.5 Hz, $^3J_{HH}$=7.5 Hz, $^4J_{HH}$=0.9 Hz, H4'), 7.01 (dd, 1H, $^3J_{HH}$=7.2 Hz, $^4J_{HH}$=1.8 Hz, H7) 6.98 (dd, 1H, $^3J_{HH}$=8.4 Hz, $^4J_{HH}$=0.6 Hz, H6'), 4.05 (s, 3H, 0-$CH_3$, 3.81 (s, 3H, O—$CH_3$).

$^{13}$C-NMR (75.5 MHz, $CDCl_3$), δ/ppm=157.5 (C2), 156.0 (C8/C1'), 155.8 (C8/C1'), 140.4 (C4/C8a/C2'), 135.1 (C4), 132.1 (C3'), 130.3 (C6/C5'), 130.2 (C4/C8a/C2'), 128.3 (C4/C8a/C2'), 126.5 (C6/C5'), 124.2 (C3), 121.5 (C4'), 119.4 (C5), 111.6 (C6'), 107.8 (C7), 56.2 (O—$CH_3$) 55.9 (O—$CH_3$).

HRMS-ESI (MeOH): calculated for $[C_{17}H_{15}N_1O_2Na]^-$: 288.0995. found: 288.0992 $[M+Na]^+$.

1.3. Preparation of 2-(2-hydroxyphenyl)quinolin-8-ol (hpc)

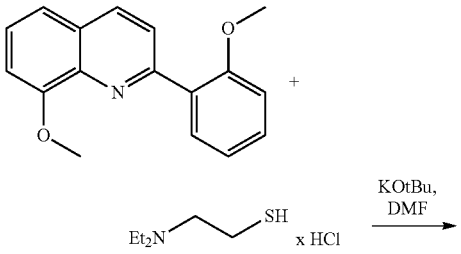

-continued

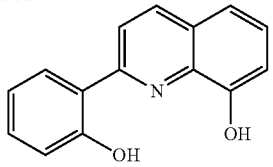

KO'Bu (18.6 g, 0.17 mol, 5.5 eq) was dissolved in 10 ml DMF and cooled to 0° C. Solid diethylaminoethane thiol hydrochloride (12.8 g, 0.08 mol, 2.5 eq) was then added in several portions. After 15 minutes the reaction mixture was warmed to room temperature. A solution of 8-methoxy-2-(2-methoxyphenyl)quinoline (8.0 g, 0.03 mol, 1.0 eq) in 20 ml DMF was slowly added drop by drop. The brown reaction mixture was heated under reflux for 1.5 hours, whereupon the color was observed to change to red-orange. The mixture was cooled down to room temperature and quenched with a little 2N HCl. After 150 ml water had been added the pH was adjusted with 2N HCl to pH 7. The deep red solution was extracted with ethyl acetate (5×60 ml) and the combined organic phases were dried over $MgSO_4$. The solvent was removed in a rotary evaporator and the residue was recrystallized from an ethanol-water mixture (5:1). The 2-(2-hydroxyphenyl)quinolin-8-ol crystallized out overnight in the form of red needles that were filtered off, washed with ether and dried under vacuum.

Yield: yellow powder to orange-red needles, 5.8 g (81%).

$^1$H-NMR (500 MHz, DMSO-$d_6$), δ/ppm=15.62 (s, 1H, OH), 10.57 (s, 1H, OH), 8.49 (d, 1H, $^3J_{HH}$=8.5 Hz, H4), 8.34 (d, 1H, $^3J_{HH}$=8.3 Hz, H3), 8.20 (d, 1H, $^3J_{HH}$=8.2 Hz, H3'), 7.48 (m, 2H, H5, H6), 7.39 (ddd, 1H, $^3J_{HH}$=7.7 Hz, $^3J_{HH}$=7.7 Hz, $^4J_{HH}$=1.2 Hz, H5'), 7.26 (dd, 1H, $^3J_{HH}$=6.2 HZ, $^4J_{hh}$=2.6 HZ, H7) 7.03 (d, 1H, $^3J_{HH}$=8.3 Hz, H6'), 6.98 (dd, 1H, $^3J_{HH}$=7.5 Hz, $^3J_{HH}$=7.5 Hz, H4').

$^{13}$C-NMR (125 MHz, DMSO-$d_6$), δ/ppm=161.5 (C1'), 156.5 (C2), 153.1 (C8), 139.0 (C4), 136.2 (C8a), 132.8 (C5'), 128.6 (C4a), 128.4 (C6), 128.3 (C3'), 119.6 (C2'), 119.5 (C4'), 119.2 (C6'), 118.7 (C5), 118.5 (C3), 114.0 (C7).

MS-EI: m/z (%): 237 (100) $[M]^+$.

HRMS-ESI (MeOH): calculated for $[C_{15}H_{12}N_1O_2]^+$: 238.0863. found: 238.0861 $[M+H]^+$.

IR-spectroscopy (KBr) $\tilde{\nu}/cm^{-1}$:3188 (s), 1605 (m), 1553 (s), 1471 (s), 1384 (m), 1293 (s), 1151 (w), 1089 (w), 833 (m), 822 (m), 745 (s), 577 (w).

Elementary analysis: $C_{15}H_{11}N_1O_2$ (M=237.3)/wt %

Calculated C, 75.94; H, 4.67; N, 5.90.

Found C, 75.73; H, 5.01; N, 5.89.

Example 2

Preparation of 2-(6-(hydroxydiphenylmethyl)pyridin-2-yl)phenol (hdpp)

2.1. Preparation of 2-(2-methoxyphenyl)pyridine

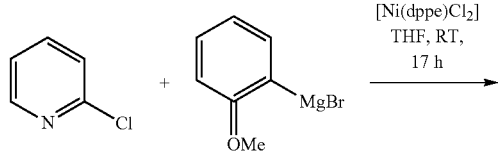

-continued

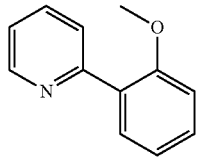

Magnesium turnings (3.2 g, 132 mmol, 1.5 eq) were vigorously stirred with an iodine crystal in 120 ml THF for 15 min to activate the metal surface. o-Bromoanisole (19.8 g, 106 mmol, 1.2 eq) was then slowly added drop by drop. This caused the reaction mixture to begin to boil and at the end of the addition it was heated under reflux for a further 50 minutes. The Grignard solution was cooled down to room temperature and added drop by drop to an already chilled solution (0° C.) of the nickel catalyst $[Ni(dppe)Cl_2]$ (1.8 g, 3.8 mol %) and 2-chloropyridine (10.0 g, 88.1 mmol, 1.0 eq) in 90 ml THF. The deep red reaction solution was stirred for 10 minutes at 0° C. and then stirred for 17 hours at room temperature. A reaction control was carried out by thin layer chromatography (hexane/ethyl acetate=7/3). The reaction was discontinued by adding 10 ml of an aqueous, concentrated solution of ammonium chloride and the solution was acidified with half concentrated aqueous HCl. The aqueous phase was washed with DCM (4×20 ml) and then neutralized with a concentrated solution of KOH. The product was extracted with DCM (4×50 ml). The combined organic extraction phases were dried over $MgSO_4$ and the solution removed in a rotary evaporator.

Yield: straw colored oil, 14.8 g (91%).

$^1$H-NMR (300.1 MHz, $CDCl_3$), δ/ppm=8.70 (ddd, 1H, $^3J_{HH}$=4.9 Hz, $^4J_{HH}$=1.8 Hz, $^5J_{HH}$=1.0 Hz, H6), 7.79 (m, 2H, $H_{Ar}$), 7.66 (ddd, 1H, $^3J_{HH}$=7.5 Hz, $^3J_{HH}$=7.9 Hz, $^4J_{HH}$=1.8 Hz, $H_{Ar}$), 7.35 (m, 1H, $H_{AT}$), 7.16 (m, 1H, $H_{Ar}$), 7.08 (dd, 1H, $^3J_{HH}$=7.5 Hz, $^4J_{HH}$=1.1 Hz, $H_{Ar}$), 6.98 (dd, 1H, $^3J_{HH}$=8.2 Hz, $^4J_{HH}$=0.9 Hz, $HA_T$), 3.81 (s, 3H, O—$CH_3$).

$^{13}$C-NMR (75.5 MHz, $CDCl_3$), δ/ppm=157.1, 156.2, 149.5, 135.8, 131.3, 130.1, 129.2, 125.3, 121.8, 121.2, 111.6, 55.7 (O—$CH_3$).

HRMS-ESI (MeOH): calculated for $[C_{12}H_{12}N_1O_1]^+$: 186.0913. found: 186.0912 $[M+H]^+$.

2.2. Preparation of
6-(2-methoxyphenyl)pyridine-2-nitrile

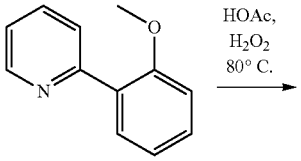

-continued

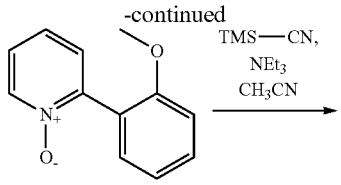

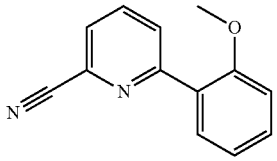

5.3 ml of a 35 percent aqueous solution of hydrogen peroxide (54.4 mmol, 1.0 eq) were slowly added drop by drop to a solution of 2-(2-methoxyphenyl)pyridine (10.1 g, 54.4 mmol, 1.0 eq) in 30 ml glacial acetic acid and the reaction solution was stirred at 80° C. After 1, 2 and 3 hours 5.3 ml of the hydrogen peroxide solution were added drop by drop each time and the reaction solution was stirred at 80° C. overnight. The progress of the reaction was followed by thin layer chromatography (hexane/ethyl acetate=1/1). The reaction solution was neutralized with solid $K_2CO_3$ until a precipitate formed. The resulting suspension was extracted with DCM (5×35 ml) and the combined organic phases were washed with aqueous $KHCO_3$ solution. After the solvent was removed, the N-oxide intermediate was obtained as a yellow golden oil in sufficient purity for the following reaction (8.9 g, 81%). The N-oxide (2.0 g, 9.9 mmol, 1.0 eq) together with triethylamine (1.7 g, 16.8 mmol, 1.7 eq) and TMS-CN (2.65 g, 16.7 mmol, 2.7 eq) was dissolved in 20 ml acetonitrile. The red-brown solution was heated under reflux for 17 hours. The progress of the reaction was followed by thin layer chromatography (hexane/ethyl acetate=7/3). At the end of the reaction, aqueous, concentrated $NaHCO_3$ solution was added until a cream colored precipitate precipitated out. On adding more $NaHCO_3$ solution, the precipitate re-dissolved. Water was added and the organic solvent was removed in a rotary evaporator. The aqueous phase was extracted with DCM (4×20 ml). The crude product was purified by separative column chromatography (0.3 cm×18 cm, silica gel, DCM).

Yield after 2 steps: white solid, 853 mg (41%).

$r_f$(DCM): 0.57.

$^1$H-NMR (300.1 MHz, $CDCl_3$), δ/ppm=8.12 (dd, 1H, $^3J_{HH}$=8.2 Hz, $^4J_{HH}$=1.0 Hz, H5), 7.85 (dd, 1H, $^3J_{HH}$=7.7 HZ, $^4J_{HH}$=1.5 Hz, H3'), 7.81 (dd, 1H, $^3J_{HH}$=7.7 Hz, $^3J_{HH}$=7.7 Hz, H4), 7.59 (dd, 1H, $^3J_{HH}$=7.5 Hz, $^4J_{HH}$=1.0 Hz, H3), 7.43 (ddd, 1H, $^3J_{HH}$=8.2 Hz, $^3J_{HH}$=7.5 Hz, $^4J_{HH}$=1.8 Hz H5'), 7.10 (dd, 1H, $^3J_{HH}$=7.5 Hz, $^4J_{HH}$=1.0 Hz, H4'), 7.02 (d, 1H, $^3J_{HH}$=8.3 Hz, H6'), 3.88 (s, 3H, O—$CH_3$).

$^{13}$C-NMR (75.5 MHz, $CDCl_3$), δ/ppm=158.1 (C6/C1'), 157.4 (C6/C1'), 136.8 (C4), 133.8 (C2), 131.7 (C3'), 131.5 (C5'), 128.8 (C5), 127.2 (C2'), 126.6 (C3), 121.6 (C4'), 117.9 (CN), 111.8 (C6'), 55.9 (O—$CH_3$).

HRMS-ESI (MeOH) m/z: calculated for $[C_{13}H_{10}N_2O_1Na]^+$: 233.0685. found: 233.0685 $[M+Na]^+$. IR-spectroscopy (KBr) $\tilde{\nu}/cm^{-1}$: 2966 (w), 2836 (w), 2229 (w), 1602 (m), 1583 (s), 1494 (m), 1463 (m), 1494 (m), 1258 (s), 1170 (w), 1128 (w), 1023 (m), 812 (w), 753 (s).

2.3. Preparation of (6-(2-methoxyphenyl)pyridin-2-yl)diphenyl-methanol

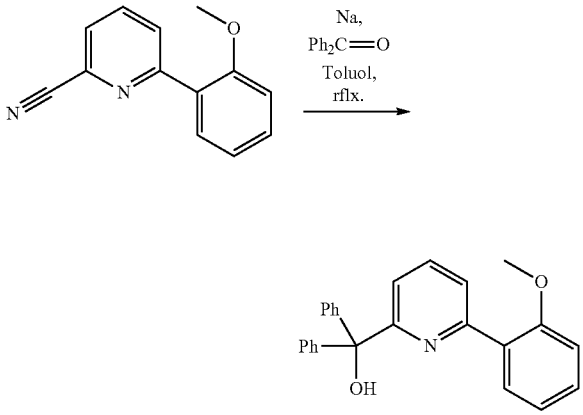

To elemental sodium (75 mg, 3.26 mmol, 2.2 eq) in 20 ml toluene was added 6-(2-methoxy-phenyl)pyridine-2-nitrile (312 mg, 1.48 mmol, 1.0 eq) and benzophenone (270 mg, 1.48 mmol, 1.0 eq). The reaction mixture was heated under reflux. The reaction solution turned deep blue. After 3.5 hours the mixture was cooled to room temperature and the reaction was quenched by adding 10 ml water. The pH of the reaction mixture was adjusted to pH 7-8 by adding aqueous $NaHCO_3$ solution and 1N HCl and the mixture was extracted with ethyl acetate (3×10 ml). The combined yellow-orange organic phases were dried over $MgSO_4$ and the solvent removed under reduced pressure. The product was purified by column chromatography (0.3 cm×18 cm, silica gel 60, eluent: ethyl acetate/hexane=2/8).

Yield: light yellow solid, 421 mg (83%).

$r_f$ (ethyl acetate/hexane=2/8): 0.32.

$^1$H-NMR (300.1 MHz, $CDCl_3$), δ/ppm=7.77-7.72 (m, 2H, $H_{Ar}$), 7.52 (dd, 1H, $^3J_{HH}$=7.8 Hz, $^3J_{HH}$=7.8 Hz, $H_{Ar}$), 7.28-7.12 (m, 11H, $H_{Ar}$), 6.97-6.89 (m, 3H, $H_{Ar}$), 6.68 (s, 1H, OH), 3.72 (s, 3H, O—$CH_3$).

$^{13}$C-NMR (75.5 MHz, $CDCl_3$), δ/ppm=162.4, 157.4, 153.8, 146.8, 136.5, 131.6, 130.6, 128.6 (4×C, $Ph_2C$—OH), 128.3 (4×C, $Ph_2C$—OH), 127.5 (2×C, $Ph_2C$—OH), 126.8, 123.9, 121.3, 121.2, 111.7, 81.1 ($Ph_2C$—OH), 55.8 (O—$CH_3$).

EI-MS: m/z (%): 367 (100) $[M]^+$, 290 (75) $[M-C_6H_6]^+$, 185 (50) $[C_{12}H_{11}NO]^+$, 77 (62) $[C_6H_6]$.

2.4. Preparation of 2-(6-(hydroxydiphenylmethyl)pyridin-2-yl)phenol (hdpp)

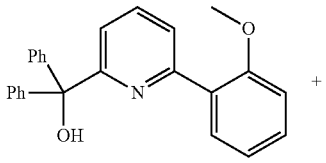

-continued

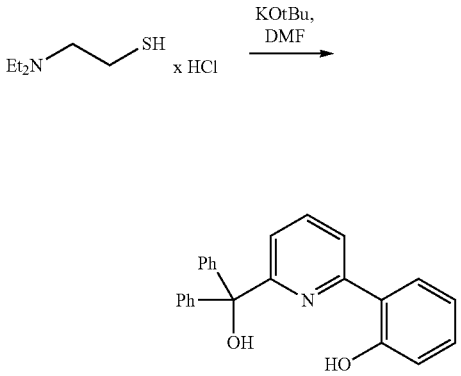

To a suspension of KO$^t$Bu (1.02 g, 9.13 mmol, 3.9 eq) pre-cooled to 0° C. in 8 ml DMF was added solid diethylaminoethane thiol hydrochloride (516 mg, 3.04 mmol, 1.3 eq). The mixture was stirred for 15 min at 0° C., then a solution of (6-(2-methoxyphenyl)pyridin-2-yl)diphenylmethanol (860 mg, 2.34 mmol, 1.0 eq) in 10 ml DMF was slowly added drop by drop. The resulting light yellow suspension was stirred at room temperature for 15 minutes and then heated under reflux for 2 h 15 min. The reaction was followed by means of thin layer chromatography (ethyl acetate/hexane=4/6). During the reaction the solution turned yellow and later through fluorescent green yellow to brown-green. The reaction was quenched by adding 2N aqueous HCl and the pH of the solution was adjusted to pH 7 with an aqueous solution of $NaHCO_3$. The aqueous phase was extracted with ethyl acetate (4×20 ml) and after drying the combined organic phases over $MgSO_4$, the solvent was removed under reduced pressure. The brown residue was dissolved in chloroform and hexane was added until a cloudiness began. The crystalline precipitate that formed on standing overnight at 4° C. was filtered off, washed with hexane and dried under vacuum.

Yield: pale yellow powder, 529 mg (64%).

$r_f$ (ethyl acetate/hexane=2/8): 0.27.

$^1$H-NMR (500 MHz, DMSO-$d_6$), δ/ppm=13.16 (s, 1H, Ar—OH), 8.11-8.05 (m, 2H, H4, H5), 8.00 (d, 1H, $^3$JHH=8.1 Hz, H3'), 7.73 (d, 1H, $^3J_{HH}$=7.7 Hz, H3), 7.38-7.26 (m, 11H, 10×$Ph_2$, H5'), 6.92-6.89 (m, 1H, H4'), 6.88 (s, 1H, C—OH), 6.79 (d, 1H, $^3J_{HH}$=8.2 Hz, H6').

$^{13}$C-NMR (125 MHz, DMSO-$d_6$), δ/ppm=164.2 (C2), 159.7 (C1'), 156.2 (C6), 147.2 (2×C($C_6H_6$)$_2$), 139.8 (C4), 132.1 (C5'), 128.7 and 128.6 (8×C, ($C_6H_6$)$_2$), 127.98 (C3'), 127.96 (2×C, ($C_6H_6$)$_2$), 121.1 (C5), 119.7 (C2'), 119.6 (C4'), 118.8 (C3), 118.7 (C6'), 81.9 (C—OH).

HRMS-ESI (MeOH): m/z: calculated for $[C_{24}H_{19}N_1O_2]^+$: 354.1489. found: 354.1481 $[M+H]^+$. MS-EI: m/z (%): 353 (52) $[M]^+$, 276 (9) $[M-Ph]^+$, 170 (17) $[M-Ph_2C—OH]^+$, 77 (53) $[C_6H_6]^+$.

IR-spectroscopy (KBr) $\tilde{\nu}$/cm$^{-1}$: 3445 (s), 3055 (w), 3024 (w), 1593 (s), 1560 (m), 1491 (w), 1458 (s), 1413 (w), 1336 (m), 1296 (m), 1178 (m), 1151 (m), 765 (m), 754 (s), 700 (s).

Elementary analysis: $C_{24}H_{19}N_1O_2$ (M=353.43)/wt %

Calculated C, 81.56; H, 5.42; N, 3.96.

Found C, 81.00; H, 5.49; N, 3.81.

Example 3

Preparation of $[Mn(hpc)]_2$ (A)

(A)

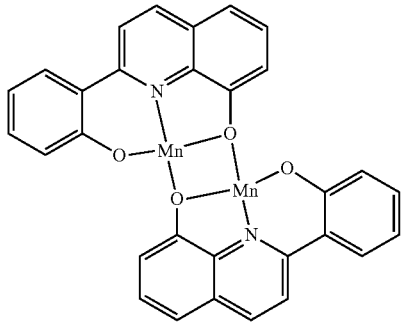

A solution of the hpc ligand synthesized according to Example 1 (1.0 g, 4.2 mmol, 1.0 eq) and triethylamine (850 mg, 8.4 mmol, 2.0 eq) in 90 ml degassed methanol was slowly added drop by drop to a solution of $Mn(BF_4)_2 \times 6H_2O$ (1.4 g, 4.2 mmol, 1.0 eq) in 30 ml degassed methanol. The mixture was then stirred at room temperature for 15 minutes and subsequently heated under reflux for two hours. The mixture was then cooled down to room temperature, the resulting precipitate was centrifuged off, washed three times with degassed methanol and dried under vacuum. Repeated freezing of the flask in liquid nitrogen and subsequent thawing to room temperature under vacuum (freeze drying) afforded the partially agglomerated material as a fine powder.

Yield: light yellow powder, 1.1 g (89%).

MALDI-MS: m/z: 290.0 $[M]^+$, 579.1 $[M_2]^+$.

HRMS-APCI (MeOH): m/z: calculated for $[C_{15}H_9Mn_1N_1O_2]^+$: 290.0008. found: 290.0002 $[M/2]^+$.

IR-spectroscopy (KBr) $\tilde{\nu}/cm^{-1}$: 3043 (w), 1601 (m), 1551 (m), 1503 (m), 1465 (s), 1429 (m), 1378 (w), 1334 (m), 1315 (w), 1271 (m), 1238 (m), 1125 (w), 1099 (m), 827 (m), 737 (s).

Elementary analysis: $C_{15}H_9MnNO_2$ (M=308.2)/wt %

Calculated C, 62.09; H, 3.13; N, 4.83; Mn, 18.93.

Found C, 57.54; H, 3.22; N, 4.37; Mn, 18.93.

Example 4

Preparation of [Mn(hpc)(acac)(MeOH)] (B)

(B)

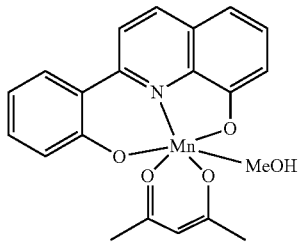

A solution of the hpc ligand synthesized according to Example 1 (498 mg, 2.1 mmol, 1.0 eq) in 60 ml methanol was slowly added to a solution of $[Mn(acac)_3]$ (740 mg, 2.1 mmol, 1.0 eq) in 50 ml methanol. The color of the reaction solution veered from yellow-black to red-brown. The solution was heated under reflux for 1 h. The almost homogeneous reaction mixture was transferred through a syringe filter (0.45 μm) into a second Schlenk flask. The complex crystallized out over 3 days at −30° C. in the form of fine needles. The crystalline precipitate was filtered off and dried under vacuum. Suitable crystals for the X-ray analysis could be obtained by dissolution in methanol and diffusion of diethyl ether.

Yield: brown needles, 433 mg (53%).

HRMS-EI (MeOH): m/z: calculated for $[C_{20}H_{16}N_1Mn_1O_4]^+$: 389.0477. found: 389.0467 $[M\text{-}MeOH]^+$; calculated for $[C_{15}H_9NiMn_1O_2]^+$: 290.0017. found: 290.0015 $[M\text{-}MeOH\text{-}acac]^+$.

EI-MS: m/z (%): 389 $[M\text{-}MeOH]^+$ (60), 329 $[M\text{-}Phenoxy]^+$ (40), 290 $[M\text{-}MeOH\text{-}acac]^+$ (100), 154 $[Mn(acac)]^+$ (15), 100 $[acac+H]^+$ (30).

HRMS-ESI (MeOH): m/z: calculated for $[C_{24}H_{19}N_1Mn_1O_3]^+$: 322.0270. found: 322.0270 $[M\text{-}acac]^+$.

IR-spectroscopy (KBr): $\tilde{\nu}/cm^{-1}$: 3165 (m), 3063 (w), 2913 (w), 1593 (s), 1543 (m), 1502 (s), 1472 (m), 1387 (s), 1327 (m), 1262 (m), 1022 (s), 930 (w), 841 (m), 829 (m), 748 (s).

Elementary analysis: $C_{21}H_{20}MnNO_5$ (M=421.3)/wt %

Calculated C, 59.86; H, 4.78; N, 3.32; Mn, 13.04.

Found C, 59.80; H, 4.77; N, 3.29; Mn, 13.20.

Example 5

Preparation of [Mn(hpe)(terpy)] (C)

(C)

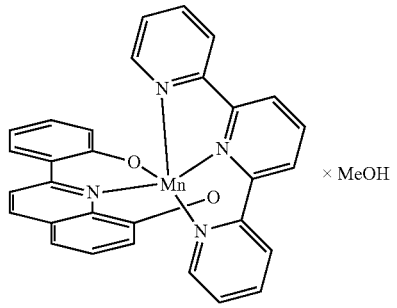

To a solution of $Mn(BF_4)_2 \times 6\ H_2O$ (700 mg, 2.1 mmol, 1.0 eq) in 80 ml methanol was added solid terpyridine (485 mg, 2.1 mmol, 1.0 eq). The yellow-white suspension was stirred for 20 minutes at room temperature. A solution of triethylamine (421 mg, 4.2 mmol, 2.0 eq) and the hpc ligand synthesized according to Example 1 (493 mg, 2.1 mmol, 1.0 eq) in 50 ml methanol was then added drop by drop, whereupon a color change to light orange was observed. The orange suspension was heated under reflux for 1.5 h. After cooling, the orange solid was centrifuged off, washed twice with methanol and dried under vacuum. The mother liquor was transferred through a syringe filter (0.45 μm) into a second Schlenk flask. Crystallization at −4° C. overnight afforded rod-like crystals that were suitable for X-ray analysis.

Yield: orange powder, 618 mg (53%).

HRMS-ESI (MeOH): m/z: calculated for $[C_{30}H_{20}Mn_1N_4O_2]^+$: 523.0961. found: 523.0960 $[M\text{-}MeOH]^+$.

MALDI-MS: m/z: 523.1 $[M\text{-}MeOH]^+$.

IR-spectroscopy (KBr) $\tilde{\nu}/cm^{-1}$: 3045 (m), 1593 (m), 1537 (m), 1470 (s), 1450 (s), 1431 (m), 1346 (s), 1159 (m), 1101 (w), 1008 (m), 777 (s), 742 (s).

Elementary analysis: $C_{30}H_{19}MnN_4O_2 \times MeOH$ (M=555.5)/wt %

Calculated C, 67.03; H, 4.35; N, 10.09.

Found C, 66.66; H, 4.37; N, 10.09.

Example 6

Preparation of $[Mn(hdppp)(acac)]_2$ (D)

(D)

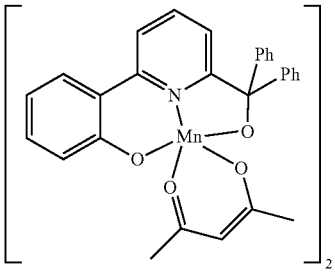

A solution of the hdppp ligand synthesized according to Example 1 (495 mg, 1.4 mmol, 1.0 eq) in 20 ml methanol was slowly added to a solution of $[Mn(acac)_3]$ (493 mg, 1.4 mmol, 1.0 eq) in 10 ml methanol. The color of the reaction solution veered from yellow-black to red-brown. The solution was heated under reflux for 1 h. After cooling, the homogeneous reaction solution was treated with enough water (ca. 30 ml) until a beige precipitate formed that on heating dissolved again. The slightly cloudy mixture was stored for several days at 4° C., thereby affording crystals that were suitable for the X-ray structural analysis. The resulting crystalline precipitate was filtered off and dried under vacuum.

Yield: brown powder, 538 mg, 76%.

HRMS-ESI (MeOH): m/z: calculated for $[C_{29}H_{24}MnNNaO_4]^+$: 528.0978. found: 528.0989 $[M/2+Na]^+$.

IR-Spectroscopy (KBr) $\tilde{\nu}/cm^{-1}$: 3437 (w), 3052 (w), 1591 (s), 1516 (m), 1455 (s), 1445 (m), 1384 (s), 1251 (m), 1044 (m), 1024 (m), 738 (s), 698 (s).

Elementary analysis: $C_{29}H_{24}MnNO_4$ (M=505.4)/wt % (contaminated)

Calculated C, 68.91; H, 4.79; N, 2.77.

Found C, 72.65; H, 5.04; N, 3.09.

Example 7

Testing the Washing Power and Fiber Damage

Primary washing power and loss of wet tear resistance on adding the synthesized complexes A, B, C and D of Examples 3 to 6 were tested in a miniaturized washing test. Firstly, a simplified washing liquor was used consisting of surfactant, $H_2O_2$ and catalyst in water. Solutions, each containing water (3° dH), 0.93 g/l surfactant, 10 mmol $H_2O_2$ and 0.0086 mmol/l (relative to Mn) of the catalysts being tested, whose pH values were adjusted to pH 10.5, were used; in comparison, an otherwise identically composed catalyst-free solution, to which 0.151 g/l TAED had been added, was tested (Table 1). Secondly, solutions of a percarbonate-containing washing agent (V1) that was free of bleach boosters and bleach catalysts, or an otherwise identically composed agent (V2) that additionally comprised 2.7 wt % TAED were used. Solutions, each with 5.88 g/l of the washing agent being tested were used, wherein the complexes A, B, C and D were each added in amounts of 0.588 mg/l (based on Mn) to each solution comprising V1 (Table 2).

For the measurement of the primary washing power, cotton substrates, stained with a standardized tea stain (T) or with a standardized blueberry juice stain (S), were treated in each of the solutions for 30 minutes at 20° C., 30° C. or 40° C. The treated material substrate was washed out under flowing water and then dried and subjected to a color measurement. In the following Table the brightness values of the cotton samples are presented (5 measurements, the average values are shown).

TABLE 2

Bleaching power in washing agent solutions

| | V1 + A | V1 + B | V1 + C | V1 + D | V2 |
|---|---|---|---|---|---|
| 20° C., T | 49.6 | 50.3 | 52.2 | 52.8 | 50.2 |
| 20° C., S | 53.9 | 54.2 | 52.9 | 54.7 | n.d. |
| 30° C., T | 53.1 | 53.5 | 54.7 | 54.4 | 53.3 |
| 30° C., S | 56.6 | 56.1 | 57.9 | 59.2 | n.d. |
| 40° C., T | 57.7 | 57.5 | 56.8 | 58.5 | 55.9 |
| 40° C., S | 60.9 | 60.9 | 59.7 | 60.9 | n.d. |

n.d.: not determined

For the measurement of the loss of wet tear strength, each cotton strip with a defined width (number of threads) was treated 20 times for 60 minutes at 60° C. in the listed washing agent solutions. The strips were dried and dipped into a wetting solution before being torn with a constant tensile testing speed by means of a tensile testing machine. The tear strength of the treated cottons was compared with the tear strength of the untreated cottons and the loss in wet tear strength was calculated in %. The average values of 5 measurements are presented in the following Table 3.

TABLE 3 loss of wet tear strength

| V1 + A | V1 + B | V2 |
|---|---|---|
| 8 | 7 | 8 |

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A washing or cleaning agent comprising a compound comprising a structure according to Formula (I), (I)

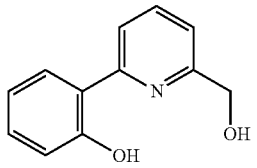

and from 5% to 50% by weight of at least one surfactant selected from the group consisting of anionic surfactants, nonionic surfactants, cationic surfactants, zwitterionic surfactants, and amphoteric surfactants, wherein the structure of Formula (I) is optionally bridged or mono or polysubstituted.

2. The agent according to claim 1, wherein at least one transition metal selected from the group consisting of Fe, Mo, Mn and W is included in the agent as part of a metal salt or as a complex with a ligand that corresponds to the compound comprising the structure according to Formula (I).

3. The agent according to claim 2, wherein the compound comprising a structure according to Formula (I) is included in the agent at a concentration ranging between 0.001 wt % and 2 wt %, and the molar ratio of the transition metal to the compound containing a structure according to Formula (I) is in the range of 0.001:1 to 2:1.

4. A washing or cleaning agent comprising a bleach catalyst that is accessed by the formation of a complex of a compound comprising a structure according to Formula (I), (I)

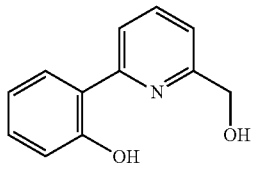

with at least one transition metal selected from the group consisting of Fe, Mo, Mn and W, and from 5% to 50% by weight of at least one surfactant selected from the group consisting of anionic surfactants, nonionic surfactants, cationic surfactants, zwitterionic surfactants, and amphoteric surfactants, wherein the structure of Formula (I) is optionally bridged or mono or polysubstituted.

5. The agent according to claim 1, further comprising up to 50 wt % of a peroxygen compound, wherein the peroxygen compound is selected from the group consisting of hydrogen peroxide, alkali metal perborate, and alkali metal percarbonate and mixtures thereof.

6. The agent according to claim 4, further comprising up to 50 wt % of a peroxygen compound, wherein the peroxygen compound is selected from the group consisting of hydrogen peroxide, alkali metal perborate, and alkali metal percarbonate and mixtures thereof.

7. The agent according to claim 4, comprising the bleach catalyzing complex that possesses a ligand containing a structure according to Formula (I), wherein the bleach catalyzing complex comprises at least one additional ligand selected from the group consisting of $H_2O$, $NH_3$, $CH_3OH$, acetylacetone, terpyridine, citrate, oxalate, tartrate, formate, a $C_{2-18}$ carboxylate, a $C_{1-18}$ alkyl sulfate or a corresponding alkane sulfonate, a halide, perchlorate, tetrafluoroborate, hexafluorophosphate, nitrate, hydrogen sulfate, hydroxide, hydroperoxide, and alkylenediamines.

8. The agent according to claim 4, wherein the compound containing a structure according to Formula (I) corresponds to a structure selected from the group consisting of the general Formula (II), in which R and $R^2$ independently of one another stand for hydrogen, a phenyl group, a benzyl group or a $C_{1-20}$ alkyl group, and the general Formula (III)

(II)

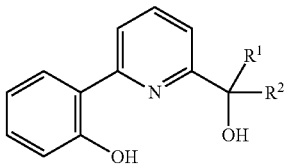

(III)

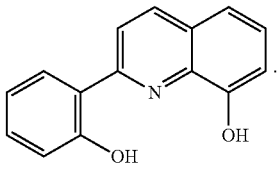

* * * * *